US005576813A

United States Patent [19]

Toyama et al.

[11] Patent Number: 5,576,813

[45] Date of Patent: Nov. 19, 1996

[54] DEVELOPING DEVICE HAVING A DISPERSION BLOCKING PLATE AND ELECTROSTATIC RECORDING DEVICE INCLUDING THE SAME

[75] Inventors: Toshimasa Toyama; Akihiko Uematsu, both of Kawasaki, Japan

[73] Assignee: Fujitsu Limited, Kanagawa, Japan

[21] Appl. No.: 533,516

[22] Filed: Sep. 25, 1995

[30] Foreign Application Priority Data

Sep. 27, 1994 [JP] Japan ..... 6-231407

[51] Int. Cl.[6] ..... G03G 15/00

[52] U.S. Cl. ..... 355/251; 118/652

[58] Field of Search ..... 355/251, 253; 118/657, 658

[56] References Cited

U.S. PATENT DOCUMENTS 4,901,116 2/1990 Haneda et al. ..... 355/253

5,479,246 12/1995 Suketomo ..... 355/251

*Primary Examiner*—Arthur T. Grimley

*Assistant Examiner*—Quana Grainger

*Attorney, Agent, or Firm*—Armstrong, Westerman, Hattori, McLeland & Naughton

[57] ABSTRACT

The present invention relates to a developing device which is arranged in an image forming device such as an electronic photo printer and an electrostatic recording-type printer and which develops developer on an electrostatic latent carrier transferring an electrostatic latent image and to an electrostatic recording device including the developing device. The object is to provide a device with high reliability which can decrease developer dispersion and the frequency of maintenance. The developing device consists of a developing roller for conveying a two-component developer by creating a magnetic brush to an electrostatic latent image carrier on which a latent image is formed and for moving in a direction opposite to the moving direction of the electrostatic latent carrier in a developing area to an electrostatic latent image carrier; a developer regulating plate for regulating the amount of the two-component developer to the developing roller; and a dispersion blocking plate protruding toward the developing area from the developer regulating plate.

13 Claims, 6 Drawing Sheets

DEVELOPING DEVICE HAVING A DISPERSION BLOCKING PLATE AND ELECTROSTATIC RECORDING DEVICE INCLUDING THE SAME

BACKGROUND OF THE INVENTION

1) Field of the Invention

The present invention relates to a developing device which creates an electrostatic latent image and an electrostatic recording device including the developing device. More particularly, the present invention relates to a developing device arranged in electrostatic recording devices such as electrophotographic printers and electrostatic recording-type printers and develops an electrostatic latent carrier which transfers an electrostatic latent image.

2) Description of the Related Art

FIG. 6 is a diagram partially illustrating a prior developing device. A photoconductive drum 1 creates a visible image to be transferred onto a paper. A magnetic developing roller 2 transfers a developer 6 onto the photoconductive drum 1 to develop an image onto the photoconductive drum 1.

A magnetic transfer roller 3 supplies the developer 6 stored in the developing device onto the developing roller 2. The doctor blade 4 regulates the amount of the developer 6 adhered to the magnetic developing roller 2 to prevent the developer 6 from being supplied excessively onto the magnetic developing roller 2.

The magnetic collection roller 5 collects the dispersed developer 6 into the developing device to reuse it.

Now let us explain briefly the structure of each of the magnetic developing roller 2 and the magnetic collection roller 5. Plural magnets are arranged in the internal portion radially and with respect to the rotational axis of each roller and covered with cylindrical sleeves. The internal magnets are fixed. Even if the roller is rotated, the internal magnets do not follow, but only the sleeves are rotated. Aluminum, for example, is used for the sleeves.

In order to print images to a sheet by the developing device with the above-mentioned structure, a latent image is first formed onto the photoconductive drum 1. Then the developer 6 stored in the developing device is supplied to the magnetic developing roller 2 via the transfer magnetic roller 3.

The doctor blade 4 regulates an excessive supply of the developer 6 to the magnetic developing roller 2. A magnetic brush (to be described later) with a predetermined height is grown on the magnetic developing roller 2.

Next, the developer (toner) 6 is supplied onto the photoconductive drum 1 on which a latent image is formed via the magnetic developing roller 2. Then a visible image is printed onto a sheet of paper by transferring the toner which is on the photoconductive drum 1.

In the brief explanation on the magnetic brush, a toner component (fine powder particles of colored resin) and magnetic components (fine magnetic carriers) coexist in the developer 6. The toner sticks onto the carrier by the electrostatic force, and the carrier on components ranged by magnetic force. The developer 6 transfers the toner with carrier. That is, the carrier attracts the toner components in plural fine particles. This state looks like the bristles planted on a brush and is called a magnetic brush.

However, in the above-mentioned developing device, the developer 6 is sustained only by the magnetic force of the magnetic developing roller 2. Hence the centrifugal force occurring as the magnetic developing roller 2 rotates or the wind pressure occurring as the photoconductive drum 1 moves may disperse the developer 6.

There is a place (magnetic force neutral area) at which the magnetic forces of the magnets arranged on the rollers 2 and 5 are balanced between the developing roller 2 and the magnetic collection roller 5, or area attraction does not occur due to the magnetic forces of the magnetic rollers 2 and 5. Such a magnetic force neutral area, as shown in FIG. 6, usually exists along the doctor blade 4 because of the relative positions at which components are arranged.

Therefore, the developer 6 dispersed first sticks on the surface of the doctor blade 4 arranged near to the developing area. It is considered that since the first dispersed developer 6 is triggered as an origin, the developer 6 dispersed accumulates continuously on the doctor blade 4.

With the developer 6 accumulated on the doctor blade 4, continuing the printing operation results in a further accumulation of the developer 6 or in contact or adhesion to the surface of the photoconductive drum 1 of the accumulated developer 6. In this case, the image created on the photoconductive drum 1 may be soiled so that the printed matter obtained by printing on a sheet may be soiled.

In order to continue good printing by preventing the above-mentioned problem, a maintenance man may manually remove the developer 6 accumulated on the doctor blade 4. However, increasing the speed of components including the photoconductive drum 1 and the magnetic developing roller 2 to execute a high-speed printing leads to an increase in the amount the developer 6 accumulated on the doctor blade 4 in a predetermined time. For that reason, it is necessary to shorten the maintenance term to clean the surface of the doctor blade 4.

Hence, the above-mentioned measure results in an increase in the personnel expenses because of frequent requests for maintenance, higher probability of soiled printed matter, and a device with lower reliability.

If some cause (vibration, an increased amount of accumulation) moves a mass of developer 6 accumulated on the doctor blade 4 onto the magnetic developing roller 2, the developer 6 may be locally thickened on the magnetic developing roller 4 so that an undesired amount of developer 6 is adhered to the surface of the photoconductive drum 1.

Hence, a large amount of the developer 6 accumulated on the member such as the doctor blade 4 existing near to the photoconductive drum 1 results in degradation in print quality.

SUMMARY OF THE INVENTION

The present invention is made to overcome the above mentioned problems. An object of the present invention is to provide a developing device that can reduce the amount of developer accumulating near to the electrostatic latent image carrier.

Another object of the present invention is to provide an electrostatic recording device including the developing device which can provide images with excellent quality.

In order to achieve the above objects, according to the present invention, the developing device is characterized by a developing roller for transferring a two-component developer by creating a magnetic brush on an electrostatic latent image carrier on which a latent image is formed, the developing roller moving in a direction opposite to the moving direction of the electrostatic latent carrier in a developing area to the electrostatic latent image carrier; a developer regulating plate for regulating the amount of the two-component developer to the developing roller; and a dispersion blocking plate protruding toward the developing area from the developer regulating plate.

Moreover, the dispersion blocking plate has a length longer than that of the developing roller in the axial direction of the developing roller.

The electrostatic recording device including a developing device is characterized by an electrostatic latent image carrier on which an electrostatic image is formed; and transferring means for being transferred medium on which a visible image is transferred out of the electrostatic latent image carrier; the developing device including a developing roller for transferring a two-component developer by creating a magnetic brush onto the electrostatic latent image carrier and for moving in a direction opposite to the moving direction of the electrostatic latent carrier in a developing area to the electrostatic latent image carrier; a developer regulating plate for regulating the amount of the two-component developer to the developing roller; and a dispersion blocking plate protruding toward the developing area from the developer regulating plate.

The developing roller creates a magnetic brush toward the electrostatic latent image carrier on which an electrostatic latent image is formed and moves in a direction opposite to the moving direction of the electrostatic latent image carrier in a developing area to transfer the two-component developer onto the electrostatic latent image carrier.

The developer regulating plate regulates the amount of the two-component developer adhered to the developing roller to supply a suitable amount of developer from the developing roller to the electrostatic latent image carrier.

Furthermore, the dispersion blocking plate protrudes toward the developing area from the developer regulating plate. Thus even if the developer is separated from the developing roller, the dispersion blocking plate prevents the developer from dispersing toward the developing regulating plate and from being affected by wind pressure occurring due to a movement of the electrostatic latent image carrier.

The electrostatic latent image carrier develops a visible image using the developer provided by the developing roller and transfers it onto a medium to be transferred by the transferring means, whereby a visible image is formed on the medium.

The dispersion blocking plate protrudes toward the developing area from the developer regulating plate. Thus even if the developer is separated from the developing roller, the dispersion blocking plate prevents the developer from dispersing toward the developing regulating plate and from being affected by wind pressure occurring due to a movement of the electrostatic latent image carrier.

As described above, according to the present invention, arranging the dispersion blocking member achieves reducing the amount of developer accumulated on components and the doctor blade arranged near to the electrostatic latent image carrier.

Moreover, of the developer dispersed from the developing area and the doctor blade, only a very small amount of developer dispersed over the dispersion blocking member accumulates in the space surrounded by the dispersion blocking member, the electrostatic latent image carrier, and the magnet collection roller. Hence there is an advantage in that the time till the developer on the electrostatic latent image carrier becomes in contact with the nearby components is remarkably prolonged so that the possibility of soiling the print image surface can be lowered.

Thus the frequent maintenance is not needed so that it is possible to reduce the personnel cost.

Moreover, since the dispersion blocking member can prevent the developer accumulated in the space, or the space surrounded by the dispersion blocking member, the electrostatic latent image carrier, and the magnetic collection roller, to move toward the magnetic developing roller side, it can be prevented that some cause (vibration, an increased amount of accumulation, and magnetic force), as described in the prior art example, disperses a mass of developer toward the magnetic developing roller. This means that the developer crossing over the dispersion blocking member moves little by little in amount toward the magnetic developing roller and does not move in a form of mass, as seen in general devices.

Hence the printing operation can be performed at a high speed and at high density and an image forming device with high print quality can be provided.

DESCRIPTION OF THE PREFERRED EMBODIMENTS

Figure 1:
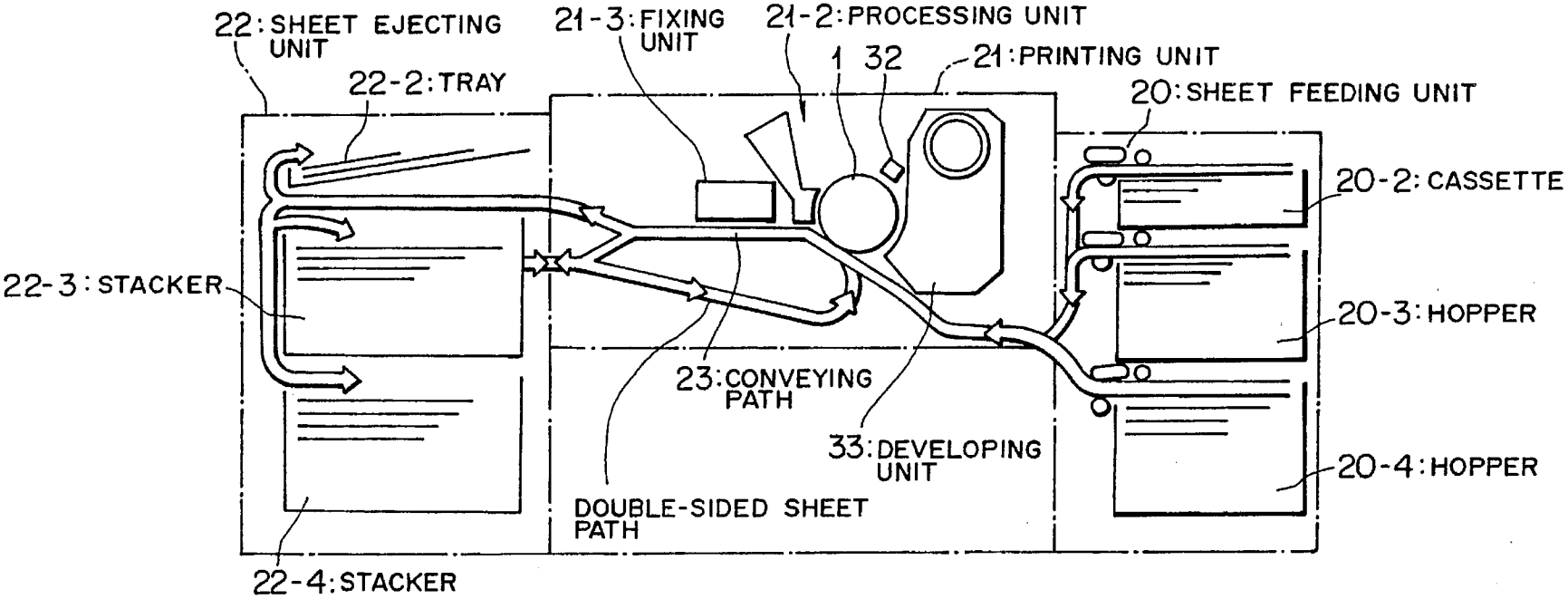
FIG. 1 is a schematic diagram showing the internal conveying path of an image forming device.

The embodiment of an electrostatic recording device according to the present invention will be described below with reference to the attached drawings. FIG. 1 is a schematic diagram showing the internal conveying path in the electrostatic recording device. The electrostatic recording device includes a sheet feeding unit 20, a printing unit 21, and a sheet distributing unit 22, each connected to the conveying unit 23 acting as conveying means.

A cassette 20-2 and hoppers 20-3 and 20-4 are arranged to the sheet feeding unit 20. The sheet feeding unit 20 is formed attachably and detachably. When a user wishes to change the kind or size of sheets temporarily, a desired size or kind of sheets can be set to the cassette.

The hoppers 20-3 and 20-4 are fixed and paper sheets with high use frequency are set in them. Two kinds of sheets with high use frequency, e.g. A-4 size and B-4 size, can be set by preparing two hoppers.

The printing unit 21 includes a processing unit 21-2 for transferring a visible image on a sheet and a fixing unit 21-3 for fixing an image onto a sheet.

The printing unit 21 includes a double-sided sheet path to enable printing onto the image surface of a sheet.

The tray 22-2 and the stackers 22-3 and 22-4 are arranged to the sheet ejecting unit 22.

The tray 22-2 stores printed matter to be quickly obtained and printed matter of a small number of sheets.

The stackers 22-3 and 22-4 each of a large capacity store a large quantity of printed matter. Different kinds of paper, or e.g. A4 size and B4 size, are respectively stored by arranging two stackers.

In order to print a sheet, sheets piled in each of the stacker 20-2 and the hoppers 20-3 and 20-4 of the sheet feeding unit 20 are sent one by one out of the top portion to feed to the printing unit 21.

In the processing unit 21-2 in the printing unit 21, an image formed based on information transmitted from the upper position is transferred onto the fed sheet.

The fixing unit 21-3 fixes the image transferred to prevent the image transferred on the sheet from being disappeared or rubbed.

The sheets are piled up in the tray 22-2 or the stackers 22-3 and 22-4. In this case, the sheets are accumulated with the printed surfaces down. When the printed matter is taken out, sheets are accumulated in the order of page by printing sequentially from the first page.

Figure 2:
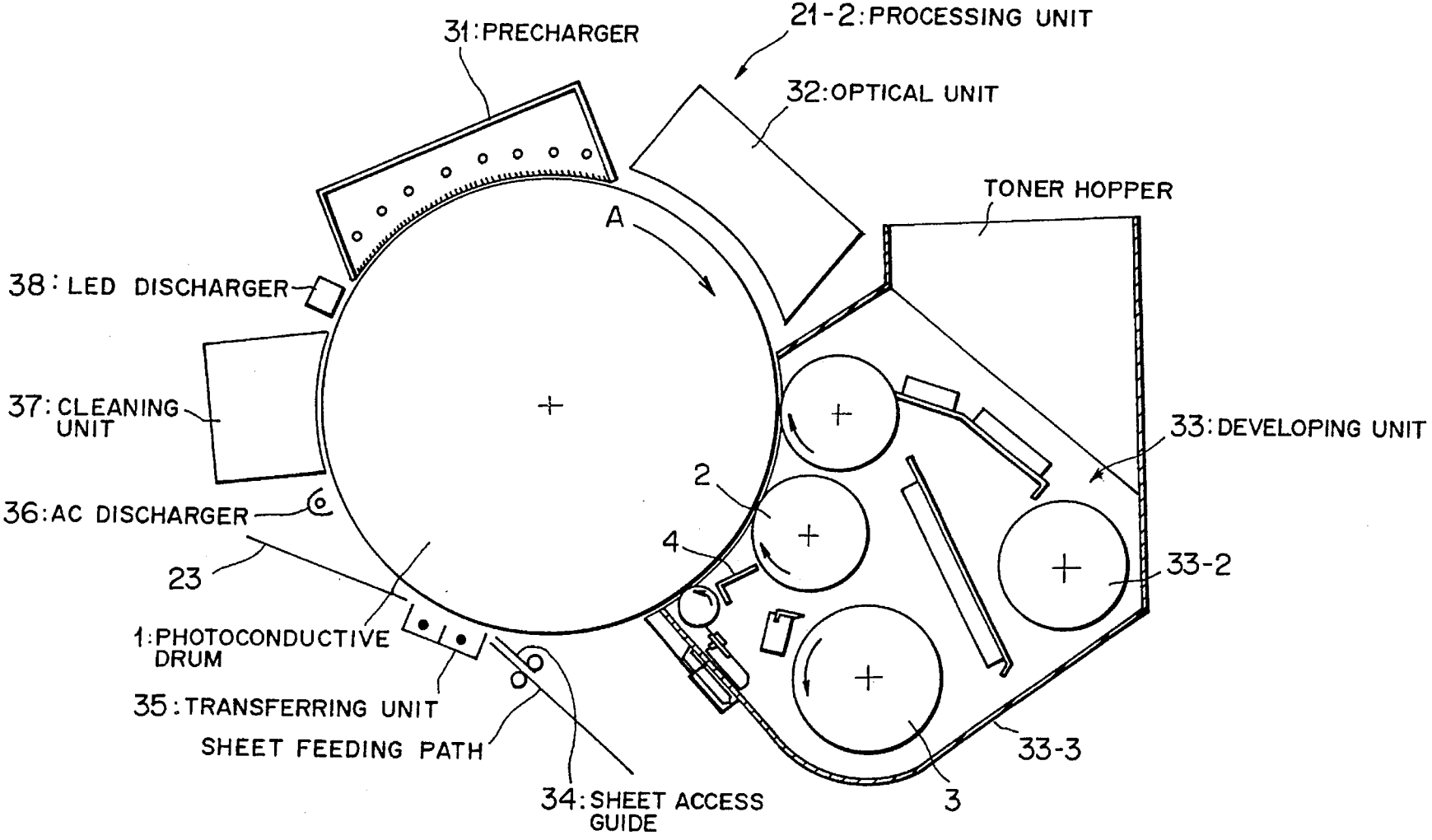
FIG. 2 is a schematic diagram showing the configuration of a processing unit.

FIG. 2 is a diagram illustrating the structure of the processing unit. As shown in FIG. 2, the processing unit 21-2 includes a processing unit 21-2 and a photoconductive drum 1 acting as an electrostatic latent image carrier, in addition to a pre-charging unit 31, an exposing unit 32, a developing unit 33, a sheet access guide 34, a transfer charging unit 35, an AC discharging unit, a cleaning unit 37, and an LED discharging unit 38 arranged around the photoconductive drum 1.

In a printing operation, the photoconductive drum 1 rotates clockwise, or in the direction of the arrow A in the figure, to charge evenly the surface of the precharging unit 31. Next, the exposing unit 32 (the optical unit used in the present embodiment) exposes the surface in a pattern according to information to form an electrostatic latent image.

The electrostatic latent image is a toner image being a visible image obtained by developing toner supplied from the developing unit 33.

On the other hand, the sheet access guide 34 guides the sheet which is supplied from the sheet feeding unit 20 via the conveying path 23 to send to the transferring position. The transfer charging unit 35 confronting via the sheet and the photoconductive drum 1 transfers toner created on the photoconductive drum 1 onto a sheet. Thereafter, the sheet is fed along the conveying path 23. Then the fixing unit 21-3 fixes the toner coated on the sheet under heat, pressure, or light.

After the transfer step, it is necessary to remove the remaining toner on the drum 1 which are not transferred on the sheet from the drum 1. The AC discharger 36 removes the electric charge of the remaining toner. Then the cleaning unit 37 removes mechanically the remaining toner on the photoconductive drum 1. A cleaning blade or a cleaning brush is used as the mechanical cleaning means.

In order to initialize the surface potential of the photoconductive drum 1 (e.g. to 0 volts) after removing the remaining toner out of the photoconductive drum 1, the discharging process is performed again using the precharger 31.

Then the precharger 31 charges evenly the surface of the photoconductive drum 1 for the next printing process.

A two-component developer consisting of a toner component (fine powder particles colored resin) and a magnetic component (fine magnetic carriers) has been widely used as the developer used in the above-mentioned developing process. The developing unit 33 which uses the two-component developer includes a developer holding container 33-3 which holds two-component developer; a stirrer 33-2 which stirs the two-component developer in the developer holding container 3-3 to frictionally charge the toner component and the magnetic carrier component; and a developing roller 2 acting as a magnetic roller which attracts magnetically part of the magnetic carriers to form a magnetic brush. Part of the developing roller 2 exposed from the developer holding container 33-3 is arranged so as to confront with the photoconductive drum 1. The magnetic brush grown on the circumference of the developing roller 2 sticks electrostatically the toner component. With the developing roller rotating, the toner component accompanied by the magnetic brush is transferred to the area, or developing area, confronting with the photoconductive drum 1 to develop the electrostatic latent image.

Since the density of the image developed the electrostatic latent image depends on the amount of toner transferred to the developing area, the length of the developer of the magnetic brush is regulated by the doctor blade 4 acting as a developer regulating plate. The length of the magnetic brush corresponds to the length of toner component attracted to the magnetic carriers by the magnetic force of magnetic carriers.

The developer 6 passed over the developing area, or the developer 6 with decreased toner component, is scraped out of the developing roller 2 with the scraping member (not shown) and then returned into the stirrer 33-2.

Figure 3:
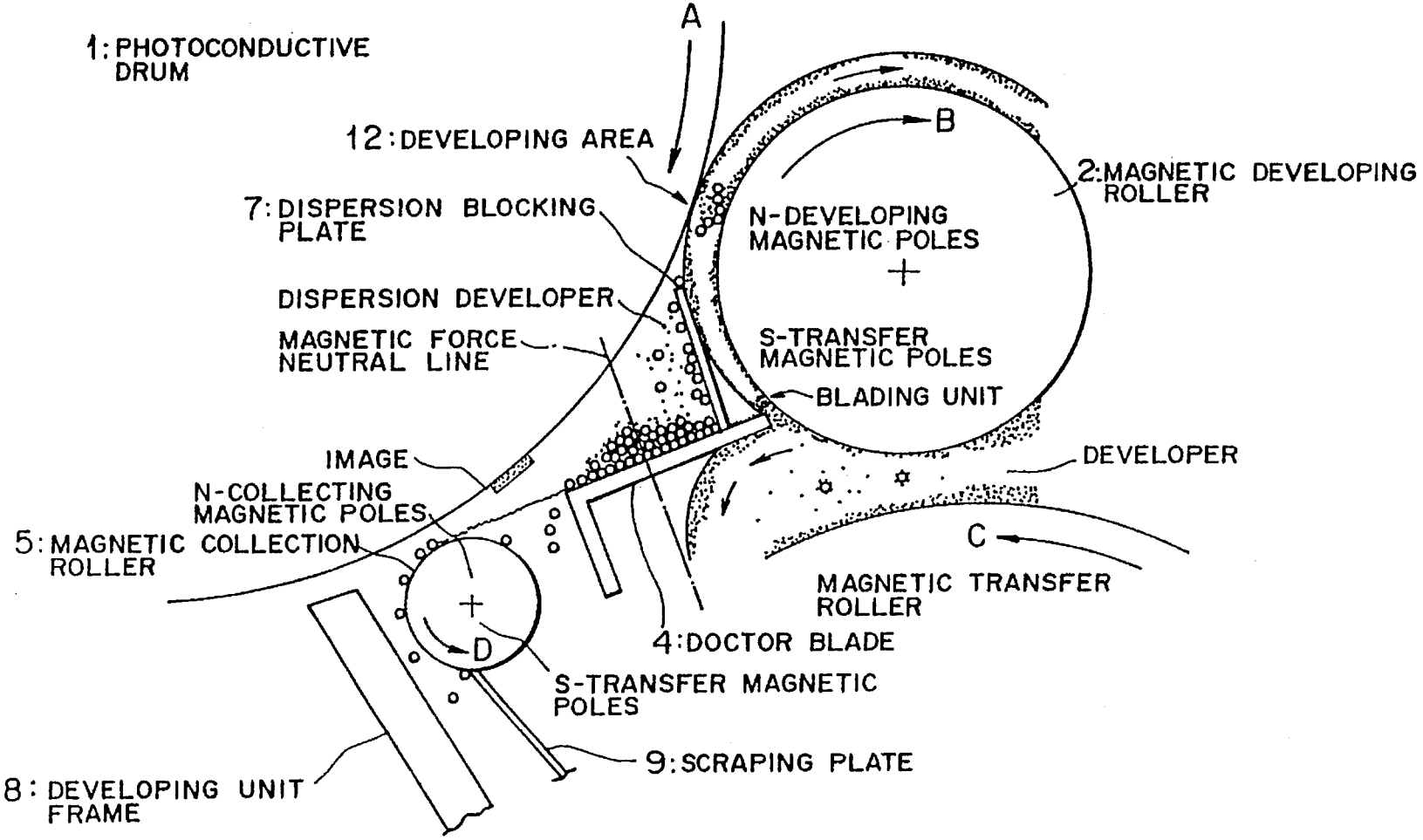
FIG. 3 is a schematic diagram illustrating a developing unit and a photoconductive drum.

FIG. 3 is a schematic diagram illustrating the developing unit and the photoconductive drum.

The developing unit 33 according to an embodiment of the present invention will be described below by referring to FIG. 3.

In the present embodiment, the developer 6 is a developer being a mixture consisting of a toner of an average grain diameter of 10 μm and a carrier of an average grain diameter of 80 μm.

As shown in FIG. 3, the image developing portion is constituted of a photoconductive drum 1 which rotates in the direction of the arrow A in the figure; a magnetic developing roller 2 being a developing roller which rotates in the direction of the arrow B in the figure; a transfer magnetic roller 3, which transfers the developer 6 onto the magnetic developing roller 2; a magnetic collection roller 5 acting as collecting member which recycles unnecessary developer 6 by the photoconductive drum 1; a doctor blade 4 which regulates the layer thickness (the amount of developer) on the magnetic developing roller 2; and a dispersion blocking plate 7 which blocks the dispersion of developer 6 out of the magnetic developing roller 2.

The photoconductive drum 1 of a diameter ø of 200 mm rotates clockwise at surface speed of 600 mm/sec, as shown in FIG. 3. Two magnetic developing rollers 2, as shown in FIG. 2, are used to improve the developing efficiency. Either one of the two rollers has a diameter ø of 200 mm and rotates clockwise at surface speed of 600 mm/sec as shown in FIG. 3. In other words, the photoconductive drum 1 and the magnetic developing roller 2 move reversely to each other at the position where the developer 6 is fed from the magnetic developing roller 2 to the photoconductive drum 1 (counter developing).

In the present invention, the second magnetic developing roller arranged on the upper side in the moving direction of the photoconductive drum 1 is omitted in the figure.

The magnetic transfer roller shown in FIG. 3 has a diameter ø of 80 mm and rotates clockwise at surface speed of 500 mm/sec, or in the direction of the arrow C shown in the figure.

The magnetic collection roller 5, shown in FIG. 3, has a diameter ø of 20 mm and rotates counterclockwise at a sleeve surface speed of 100 mm/sec, or in the same direction at the position where the photoconductive drum 1 confronts with the magnetic collection roller 5.

The spacing between the photoconductive drum 1 and the magnetic developing roller 2 is set to 2 mm and the spacing between the photoconductive drum 1 and the magnetic collection roller 5 is set to 1 mm.

The doctor blade 4 is generally arranged on the upper side of the developing unit (that is, at the position at which the photoconductive drum 1 is confronted), or at a position where it is not separated much from the developing area 12, considering the transferability of the developer 6.

It is desirable that the doctor blade 4 is arranged nearer to the developing area 12 to stabilize the amount of the developer 6 grown in the developing area 12. However, considering the flow behavior of the developer 6 returning to the magnetic transfer roller 3, the doctor blade 4 in the present embodiment is set to an angle of 60° with respect to the developing area 12.

Furthermore, considering the flow behavior of the developer 6 returning to the magnetic transfer roller 3, not to the developing area 12, it is desirable to arrange the doctor blade 4 at an obtuse angle (90° and more) with respect to the tangent line of the magnetic developing roller 3.

In this embodiment, the doctor blade 4 is set to an angle of about 100°.

Considering the flow behavior of the developer 6, the manufacturing accuracy, and easiness of processing, the length of the doctor blade 4, or the length ranging from the vicinity of the magnetic developing roller 2 to the vicinity of the magnetic collection roller 5, is necessary to a certain degree. In this embodiment, the length of the doctor blade 4 is set to 20 mm (desirable to be 10 mm).

The magnetic developing roller 2 has transfer magnetic poles to transfer the developer 6 to the developing area 12, developing magnetic poles used in the developing area 12, and transfer magnetic poles to transfer the developer 6 out of the developing area 12 (not shown).

Like the developer 6 growing on the developing area 12, it is general to arrange a transfer magnetic pole different from the above-mentioned magnetic pole to grow the developer 6 near to the doctor blade 4. Where there is a large space between the transfer magnetic pole and the developing magnetic pole, an additional transfer magnetic pole is needed. However, in this embodiment, the detail explanation on this transfer magnetic pole is omitted here.

The transfer magnetic pole arranged near to the doctor blade 4 of the magnetic developing roller 2 has a magnetic induction of 700 gauss. The developing magnetic pole arranged nearest to the photoconductive drum 1 has a magnetic induction of 800 gauss and the angle of them is set to be about 60°. This setting does not require any transfer magnetic pole between the two magnetic poles.

In the magnetic collection roller 5, the magnetic pole for collection (the portion nearest to the photoconductive drum) is set to be 100 gauss.

Figure 4:
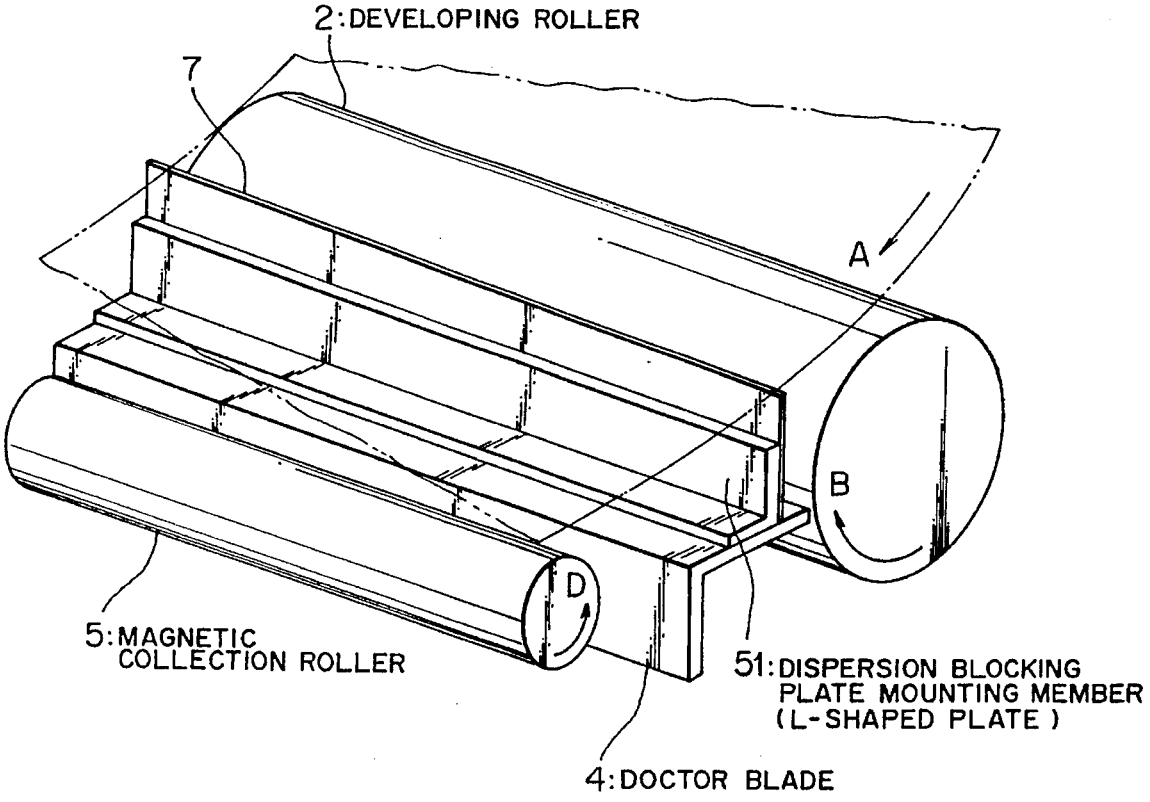
FIG. 4 is a perspective view illustrating the vicinity of a developing area.

FIG. 4 is a perspective view showing the neighboring area of the developing area.

As shown in FIG. 4, the dispersion blocking plate 7 has a length in the axial direction of the photoconductive drum 1, longer than the length (350 mm) of the magnetic developing roller 2, and has a height set to a value (about 2 mm) so as to be spaced somewhat to the photoconductive drum 1. The thickness is set to a value (about 1 mm) so that the dispersion blocking plate 7 is not warped by its weight. The material is preferably a flexible member in consideration that it may be in contact with a member near to the photoconductive drum 1 at a maintenance work. In this embodiment, Polyster plate is suitable for the plate member.

The dispersion blocking plate 7 is arranged in a space surrounded by the photoconductive drum 1, the magnetic developing roller 2, and the magnetic collection roller 5 and at the position where it is not in contact with the developer 6 coated on the magnetic developing roller 2.

Figure 5:
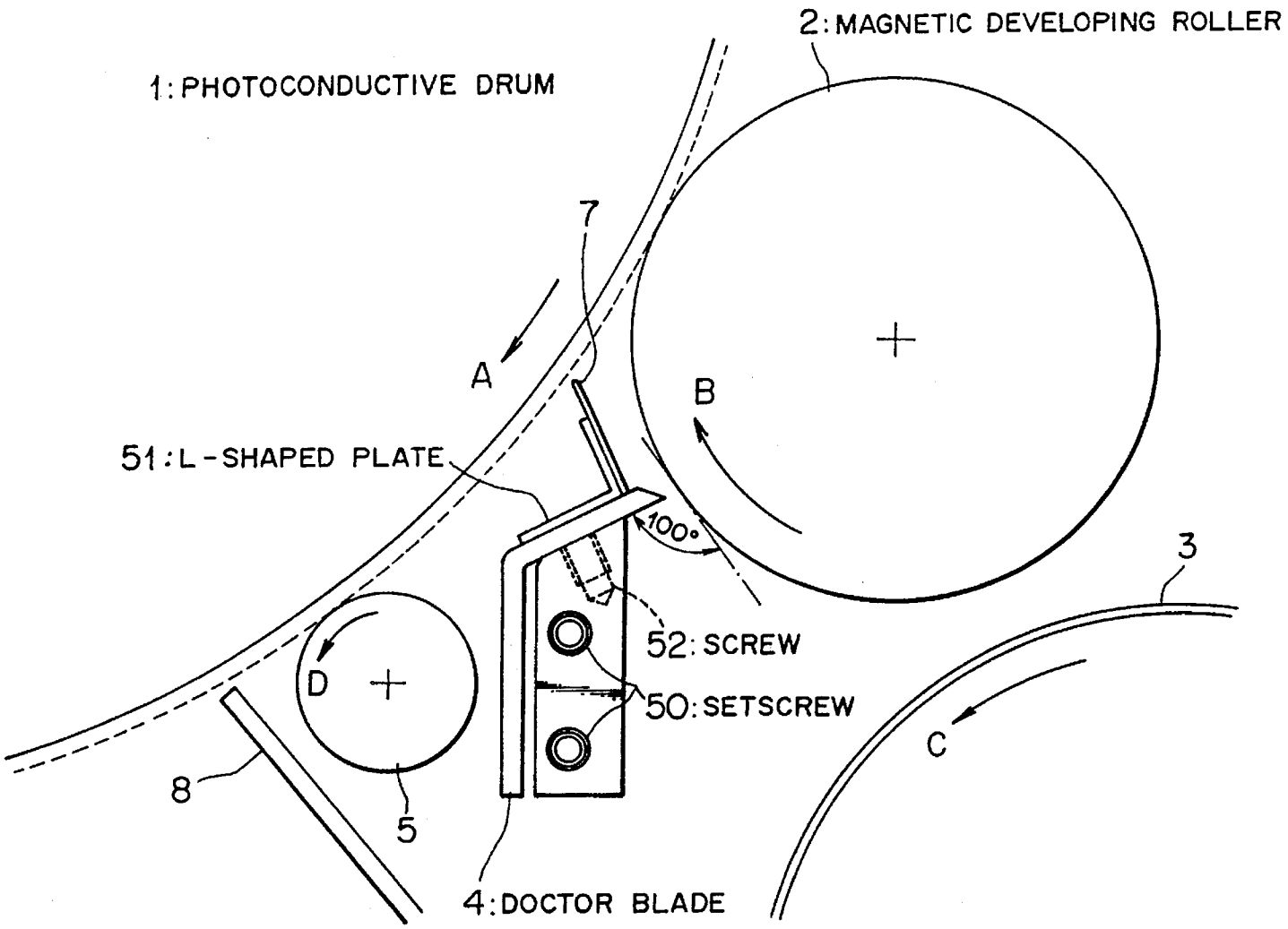
FIG. 5 is a diagram illustrating how to mount a dispersion blocking plate.
Figure 6:
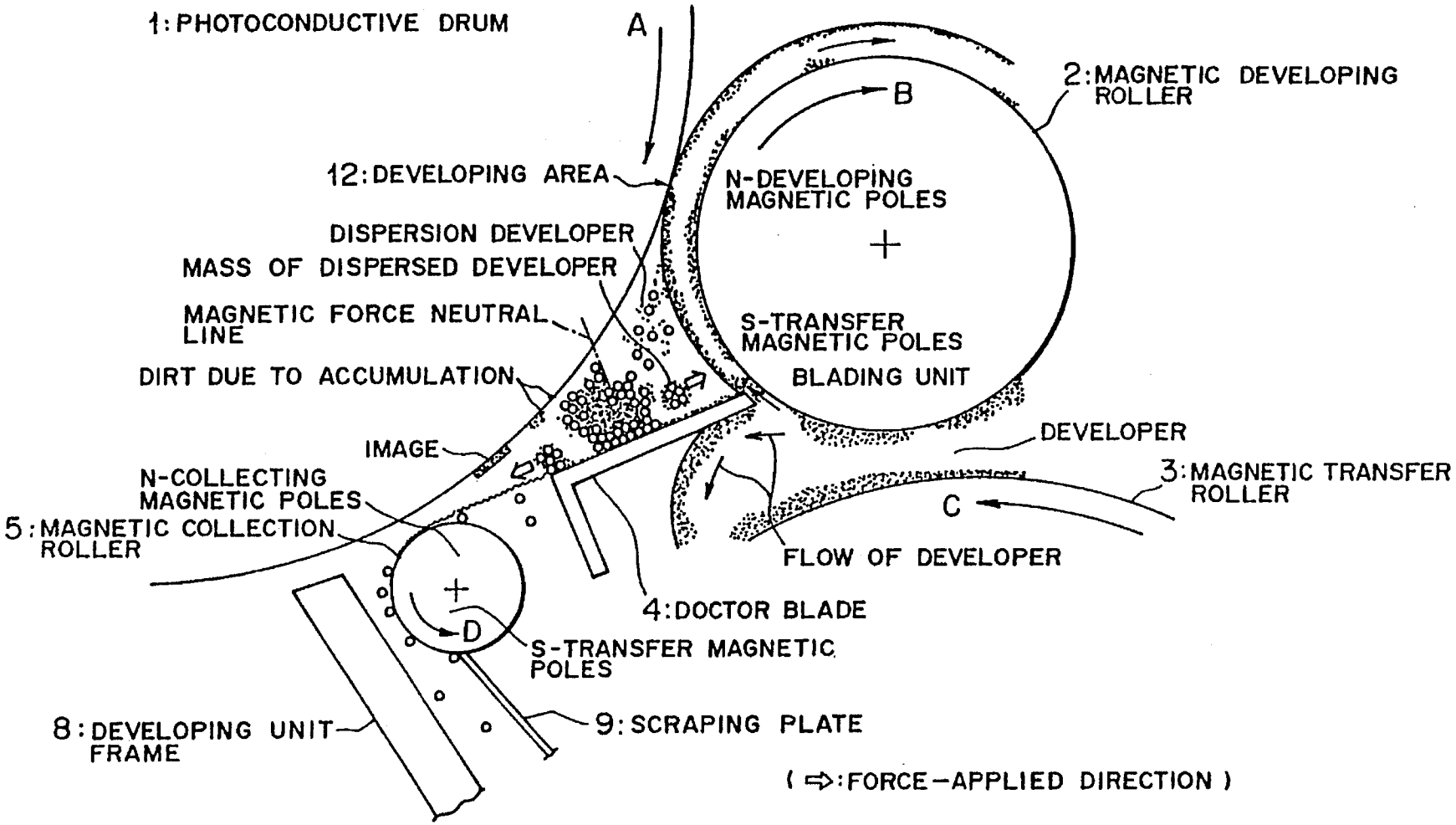
FIG. 6 ( PRIOR ART )
FIG. 6 is a diagram illustrating a prior art processing device.

FIG. 5 is a diagram illustrating the dispersion blocking plate mounted. As shown in FIG. 5, the doctor blade 4 is fixed to the developing device frame 8 with the setscrews 50.

Moreover, the dispersion blocking plate 7 is arranged on the doctor blade 4. In the mounting method, the dispersion blocking plate 7 may be adhered to the L-shaped plate (L-shaped plate 51) with a double-sided adhesive tape or bonding agent, or screws.

In this embodiment, the L-shaped plate is screwed on the back surface of the doctor blade with the screws 52.

Such a mounting allows establishing good positional accuracy, and thinnings and strengthening the tip of the dispersion blocking plate 7.

A space can be obtained on the side of the magnetic collection roller 5 of the dispersion blocking plate 7 by arranging the dispersion blocking plate 7 at a predetermined position. This space stores the developer crossing over the dispersion blocking plate 7.

In order to achieve a high-density printing and a high-speed printing (150 sheets per minute: the number of A4 sheets which can be horizontally conveyed and printed for one minute) by the developing device, it is needed to rotate the photoconductive drum 1 and the magnetic developing roller 2 at high speed and in the reverse direction to each other (counter developing). This method allows a large amount of the developer 6 of the magnetic developing roller 2 to be supplied onto the photoconductive drum 1 certainly and in short time, thus realizing a high-density and high-speed printing.

However, when the magnetic developing roller 2 rotates at high speed, the developer may be dispersed because the magnetic roller cannot hold the developer due to the centrifugal force exceeding the force (magnetic force) holding the developer 6 so that the developer is dispersed. Under the counter developing, since the developer 6 dispersed piles up on the lower side of the developing area 12, it sticks on the surface of the photoconductive drum 1 on which a visible image is formed or drifts around the vicinity thereof. The counter developing may cause a print failure such as white vacancy with strong possibility.

In order to solve the problem, a developer collection unit is arranged to collect the developer 6 dispersed on the lower side of the magnetic developing roller 2 in the developing device.

As an example, the magnetic roller 5 is often used as the developer collection unit. The magnetic collection roller 5, like the magnetic developing roller 2, absorbs the developer on the outer circumference of the sleeve having magnets therein and then transfers it by setting the rotation of the sleeve and the internal magnetic poles.

The operation of the magnetic collection roller 5 will be described below by referring to FIG. 3.

The magnetic collection roller 5 has two magnetic poles: one being a collecting magnetic pole (S-pole) arranged a portion confronting the photoconductive drum 1 and the other being a transfer magnetic pole (N-pole) arranged on the lower side in the rotating direction.

The photoconductive drum 1 attracts the developer (particularly, carriers) 6 to the sleeve under the magnetic force of the collecting magnetic pole. When the sleeve rotates, the scraping plate 9 acting as a scraping member scrapes down the developer 6 crossing the transfer magnetic poles. Then the developing device recycles and stirs the developer 6 scraped.

As described above, the magnetic collection roller 5 can remove very effectively the developer 6 stuck on the photoconductive drum 1. However, the magnetic collection roller 5 has the following problems.

With the image forming device utilizing the counter developing including the developer collecting mechanism using the magnetic force, the developer 6 dispersed near to the developing area 12 and onto the doctor blade 4 sticks often on elements arranged near to the photoconductive drum 1 and accumulates thickly with time.

Particularly, plenty of the developer 6 sticks to the doctor blade 4 arranged near to the developing area 12.

In the adhesive manner, the developer 6 first sticks on a place (a magnetic force neutral area) where the magnetic force of the magnetic collection roller 5 is balanced with that of the magnetic developing roller 2, or a place where the developer is not attracted by the magnetic force of each of the magnetic rollers 2 and 5, and then piles up one after another with the origin being the developer 6 first stuck. Thereafter, the continuous printing work accumulates a large amount of the developer sticking on the doctor blade 4, thus bringing the accumulated developer 6 into contact with the surface of the photoconductive drum 1. As a result, there is a problem in that the image drawn on the photoconductive drum is soiled.

When some cause (vibration, increased amount of accumulation, and magnetic force) transfers a mass of developer accumulated on the doctor blade onto the magnetic developing roller 2, thus growing thickly and locally the developer 6 on the magnetic developing roller 2 so that undesired developer is stuck on the surface of the photoconductive drum.

As described above, the developer 6 accumulates thickly to components adjacent to the photoconductive drum, thus resulting in degradation of the print quality.

In this embodiment, in order to provide an image forming device which does not bring the above-mentioned problem, the dispersion blocking plate 7 acting as dispersion blocking member which blocks dispersion of the developer 6 is arranged in a space surrounded by the magnetic developing roller 2, the photoconductive drum 1, and the magnetic collection roller 5 and near to the magnetic developing roller 2 so as not to be in contact with the developer coated on the magnetic developing roller 6, the photoconductive drum 1, and the magnetic collection roller 5.

Furthermore, it is more desirable that the dispersion blocking plate 7 secures a space formed between the magnetic developing roller 2 and the magnetic collection roller 5 to accumulate the developer 6.

In consideration of the outflow of the developer 6 from the end, it is desirable that the length of the dispersion blocking plate 7 acting as a dispersion blocking member is axially longer than that of the magnetic developing roller. However, if the dispersion blocking plate 7 has a length longer than the width of a magnet within the magnetic developing roller 2, there is no problem in practice so that the developer 6 flowing out of the end portion can be prevented.

The height of the dispersion blocking plate 7 acting as a dispersion blocking member is set so as to be spaced slightly from the photoconductive drum. The thickness is set so as not to be warped by the weight of the plate 7 itself. The material is preferably a flexible member, in consideration that a maintenance man may be hurt because of a contact with the photoconductive drum or a member near to the photoconductive drum at a maintenance work.

The dispersion blocking plate 7 being a dispersion blocking member allows the developer 6 dispersed from the magnetic developing roller 2 to decrease to a very small amount.

In addition, since the dispersion of the developer 6 cannot be perfectly suppressed, a space where the developer 6 is accumulated is secured on the side of the magnetic collection roller 5 of the dispersion blocking plate 7, whereby printing is not affected due to the developer 6 dispersed slightly.

The above-mentioned structure does not stick unwanted developer on the drum in the repeated image forming work, thus creating good images with no blur.

What is claimed is:

1. A developing device comprising:

a developing roller for transferring a two-component developer by creating a magnetic brush and for brushing the magnetic brush against an electrostatic latent image carrier on which a latent image is formed, said developing roller moving in a direction opposite to a moving direction of said electrostatic latent image carrier in a developing area to said electrostatic latent image carrier:

a developer regulating plate for regulating an amount of said two-component developer to said developing roller; and a dispersion blocking plate protruding toward said developing area from said developer regulating plate, wherein said dispersion blocking plate has a length longer than that of said developing roller in an axial direction of said developing roller.

2. The developing device according to claim 1, wherein said dispersion blocking plate is arranged so as to be separated from said developing roller by a distance slightly longer than a length of said magnetic brush formed to said developing roller.

3. The developing device according to claim 2, wherein said dispersion blocking plate has flexibility.

4. The developing device according to claim 1, wherein said dispersion blocking plate has flexibility.

5. A developing device comprising:

a developing roller for transferring a two-component developer by creating a magnetic brush and for brushing the magnetic brush against an electrostatic latent image carrier on which a latent image is formed, said developing roller moving in a direction opposite to a moving direction of said electrostatic latent image carrier in a developing area to said electrostatic latent image carrier;

a developer regulating plate for regulating an amount of said two-component developer to said developing roller; and a dispersion blocking plate protruding toward said developing area from said developer regulating plate wherein said dispersion blocking plate is arranged so as to be separated from said developing roller by a distance slightly longer than a length of said magnetic brush formed to said developing roller.

6. The developing device according to claim 5, wherein said dispersion blocking plate has flexibility.

7. An electrostatic recording device including a developing device comprising:

an electrostatic latent image carrier on which an electrostatic image is formed; and transferring means for transferring a visible image from said electrostatic latent image carrier to a medium;

said developing device including:

a developing roller for transferring a two-component developer by creating a magnetic brush and brushing the magnetic brush against said electrostatic latent image carrier and for moving in a direction opposite to a the moving direction of said electrostatic latent image carrier in a developing area to said electrostatic latent image carrier;

a developer regulating plate for regulating an amount of said two-component developer transferred to said developing roller; and a dispersion blocking plate protruding toward said developing area from said developer regulating plate, wherein said dispersion blocking plate has a length longer than that of said developing roller in an axial direction of said developing roller.

8. The developing device according to claim 7, wherein said dispersion blocking plate has flexibility.

9. A developing device comprising:

a developing roller for conveying a two-component developer by creating a magnetic brush and brushing the magnetic brush against an electrostatic latent image carrier on which an electrostatic latent image is formed and for moving in a direction opposite to the moving direction of said electrostatic latent image carrier in a developing area to said electrostatic latent image carrier;

a transferring roller for supplying said two-component developer to said developing roller;

a developer regulating plate for regulating an amount of said two-component developer transferred to said developing roller;

a collecting member for rotating in a same direction as that of said electrostatic latent image carrier at a position opposite to said electrostatic latent image carrier and for collecting said developer; and a dispersion blocking plate protruding toward said developing area from said developer regulating plate, wherein said dispersion blocking plate has a length longer than that of said developing roller in an axial direction of said developing roller.

10. An electrostatic recording device including a developing device comprising:

an electrostatic latent image carrier on which an electrostatic latent image is formed; and transferring means for transferring a visible image from said electrostatic latent image carrier to a medium;

said developing device including:

a developing roller for conveying a two-component developer by creating a magnetic brush and brushing the magnetic brush against said electrostatic latent image carrier on which said electrostatic latent image is formed and for moving in a direction opposite to a moving direction of said electrostatic latent image carrier in a developing area to said electrostatic latent image carrier;

a transferring roller for transferring said two-component developer to said developing roller;

a developer regulating plate for regulating an amount of said two-component developer transferred to said developer roller;

a collecting member for rotating in the same direction as that of said electrostatic latent image carrier at a position opposite to said electrostatic latent image carrier and for collecting said developer; and a dispersion blocking plate protruding toward said developing area from said developer regulating plate, wherein said dispersion blocking plate has a length longer than that of said developing roller in an axial direction of said developing roller.

11. An electrostatic recording device including a developing device comprising:

an electrostatic latent image carrier on which an electrostatic image is formed; and transferring means for transferring a visible image from said electrostatic latent image carrier to a medium;

said developing device including:

a developing roller for transferring a two-component developer by creating a magnetic brush and brushing said magnetic brush against said electrostatic latent image carrier, and for moving in a direction opposite to a moving direction of said electrostatic latent image carrier in a developing area to said electrostatic latent image carrier;

a developer regulating plate for regulating an amount of said two-component developer transferred to said developing roller; and a dispersion blocking plate protruding toward said developing area from said developer regulating plate, wherein said dispersion blocking plate is arranged so as to be separated from said developing roller by a distance slightly longer than a length of said magnetic brush formed on said developing roller.

12. A developing device comprising:

a developing roller for conveying a two-component developer by creating a magnetic brush and brushing said magnetic brush against an electrostatic latent image carrier on which an electrostatic latent image is formed and for moving in a direction opposite to a moving direction of said electrostatic latent image carrier in a developing area to said electrostatic latent image carrier;

a transferring roller for supplying said two-component developer to said developing roller;

a developer regulating plate for regulating an amount of said two-component developer transferred to said developing roller;

a collecting member for rotating in a same direction as that of said electrostatic latent image carrier at a position opposite to said electrostatic latent image carrier and for collecting said developer; and a dispersion blocking plate protruding toward said developing area from said developer regulating plate, wherein said dispersion blocking plate is arranged so as to be separated from said developing roller by a distance slightly longer than a length of said magnetic brush formed on said developing roller.

13. An electrostatic recording device including a developing device comprising:

an electrostatic latent image carrier on which an electrostatic latent image is formed; and transferring means for transferring a visible image from said electrostatic latent image carrier to a medium.

said developing device including:

a developing roller for conveying a two-component developer by creating a magnetic brush and brushing said magnetic brush against said electrostatic latent image carrier on which said electrostatic latent image is formed and for moving in a direction opposite to a moving direction of said electrostatic latent carrier in a developing area to said electrostatic latent image carrier;

a transferring roller for transferring said two-component developer to said developing roller;

a developer regulating plate for regulating an amount of said two-component developer transferred to said developer roller;

a collecting member for rotating in the same direction as that of said electrostatic latent image carrier at a position opposite to said electrostatic latent image carrier and for collecting said developer; and a dispersion blocking plate protruding toward said developing area from said developer regulating plate, wherein said dispersion blocking plate is arranged so as to be separated from said developing roller by a distance slightly longer than a length of said magnetic brush formed to said developing roller.

* * * * *